US011401681B2

(12) United States Patent
Levesque et al.

(10) Patent No.: US 11,401,681 B2
(45) Date of Patent: Aug. 2, 2022

(54) SNAP ON METER PIT EXTENSION

(71) Applicant: Bingham & Taylor Corp., Rocky Hill, CT (US)

(72) Inventors: Kevin J. Levesque, Pittsford, NY (US); Randy Gibson, Locust Grove, VA (US); Mark de Lancellotti, San Clemente, CA (US)

(73) Assignee: Bingham & Taylor Corp., Rocky Hill, CT (US)

( * ) Notice: Subject to any disclaimer, the term of this patent is extended or adjusted under 35 U.S.C. 154(b) by 0 days.

(21) Appl. No.: 16/397,601

(22) Filed: Apr. 29, 2019

(65) Prior Publication Data

US 2019/0330817 A1 Oct. 31, 2019

Related U.S. Application Data

(60) Provisional application No. 62/663,602, filed on Apr. 27, 2018.

(51) Int. Cl.
*E02D 29/12* (2006.01)
*E03F 5/02* (2006.01)
(Continued)

(52) U.S. Cl.
CPC ..... *E02D 29/121* (2013.01); *E02D 29/124* (2013.01); *E03B 7/095* (2013.01); *E03F 5/02* (2013.01); *E03B 9/10* (2013.01)

(58) Field of Classification Search
CPC ..... E02D 29/121; E02D 29/12; E02D 29/124; E02D 29/1427; E02D 29/1463; E03F 5/02;
(Continued)

(56) References Cited

U.S. PATENT DOCUMENTS 3,499,574 A * 3/1970 Yates, Jr. ..... B65D 45/322 220/784
3,514,010 A * 5/1970 Rossi ..... B60Q 3/74 220/293
(Continued)

FOREIGN PATENT DOCUMENTS

DE 102013003307 A1 * 8/2014
EP 83007 A1 * 7/1983
(Continued)

OTHER PUBLICATIONS

Derwent Abstract of WO 2005111319 A1 (Year: 2005).*
Derwent Abstract of CN 108661082 A (Year: 2018).*

*Primary Examiner* — Brian D Mattei
*Assistant Examiner* — Charissa Ahmad
(74) *Attorney, Agent, or Firm* — St. Onge Steward Johnston & Reens LLC

(57) ABSTRACT

A pit and an extension, each having flanges extending perpendicular to an axis of the pit and extension. The pit includes holes extending outwardly in the wall of the pit, preferably these holes are located at one end of the pit. Surfaces of the flanges are configured to mate together and clips secure the flanges together to inhibit movement apart of the pit and extension along the axis. In certain embodiments, the extension includes support ribs which may be both interior and exterior and the extension narrows from its flange towards an opposite end thereof.

17 Claims, 17 Drawing Sheets

(51) Int. Cl.
*E03B 7/09* (2006.01)
*E03B 9/10* (2006.01)

(58) Field of Classification Search
CPC ..... B65D 50/061; B65F 1/1615; E03B 9/10; E03B 7/095
See application file for complete search history.

(56) References Cited

U.S. PATENT DOCUMENTS 3,688,942 A * 9/1972 Mitchell ..... B65D 43/0218 220/784
3,703,974 A * 11/1972 Boxer ..... B65D 50/061 215/217
3,811,597 A * 5/1974 Frankenberg ..... B65D 43/0212 220/284
3,902,628 A * 9/1975 Schurman ..... B65D 43/164 220/835
4,333,580 A * 6/1982 Sweigart, Jr. ..... E04H 1/1238 220/293
4,723,686 A * 2/1988 Pennisi ..... B65F 1/1615 220/300
5,065,911 A * 11/1991 Rohr ..... B65D 47/0861 222/517
5,411,161 A * 5/1995 Fish, Jr. ..... B65D 50/061 220/293
5,538,154 A * 7/1996 Von Holdt ..... B65D 43/0256 220/277
5,617,679 A * 4/1997 Meyers ..... E02D 29/12 220/4.26
5,641,065 A * 6/1997 Owens ..... B65D 45/20 206/363
5,772,361 A * 6/1998 Gavin ..... E03F 11/00 220/565
5,852,901 A * 12/1998 Meyers ..... E02D 29/12 52/20
6,039,778 A * 3/2000 Coulonvaux ..... F02M 35/0203 55/498
D429,965 S * 8/2000 Hayes ..... B65D 90/023 D7/602
6,415,947 B1 * 7/2002 Kim ..... B65D 43/0218 220/788
6,436,162 B1 * 8/2002 Wake ..... B01D 35/30 55/498
6,484,451 B1 * 11/2002 Gavin ..... E02D 29/12 220/4.03
6,749,080 B1 * 6/2004 White ..... E03B 7/095 137/371
6,793,096 B1 * 9/2004 Seok ..... B65D 43/0218 220/326
6,986,227 B1 * 1/2006 Gavin ..... E02D 29/12 220/4.27
7,574,831 B2 * 8/2009 Meyers ..... E02D 29/12 404/25
7,627,992 B1 * 12/2009 Gavin ..... E02D 29/12 174/39
7,735,665 B2 * 6/2010 Robinson ..... B65D 47/0814 215/237
7,770,333 B2 * 8/2010 Meyers ..... F16L 41/08 52/19
7,854,344 B2 * 12/2010 Suk ..... B65D 43/0212 220/326
7,926,510 B1 * 4/2011 Terry, III ..... E03F 11/00 137/363
8,245,867 B2 * 8/2012 Allen ..... B65D 43/0218 220/285
8,251,245 B2 * 8/2012 DiPietro ..... B65D 43/0212 220/324
8,308,010 B2 * 11/2012 Letica ..... B65D 43/0279 220/293
8,387,822 B2 * 3/2013 Antal, Sr. ..... B65D 45/24 220/786
8,733,550 B2 * 5/2014 Harvey ..... B65D 53/02 206/508
9,889,986 B2 * 2/2018 Holbrook ..... B65D 90/06
10,442,617 B1 * 10/2019 Holbrook ..... B65D 90/023
2004/0040221 A1 * 3/2004 Airheart ..... E02D 29/12 52/20
2005/0103694 A1 * 5/2005 Rost ..... E03F 1/00 210/164
2006/0042174 A1 * 3/2006 Meyers ..... E03F 11/00 52/20
2011/0272953 A1 * 11/2011 Mercier ..... B65F 1/1468 292/195
2013/0334229 A1 * 12/2013 McCanless ..... B65F 1/1615 220/324
2013/0336723 A1 * 12/2013 McKinney ..... E02D 29/121 405/129.55
2015/0176239 A1 * 6/2015 Ducote ..... B65D 88/78 137/377
2016/0052682 A1 * 2/2016 Gunnerson ..... B65D 45/24 220/326
2018/0223498 A1 * 8/2018 Bechler ..... E03F 5/042
2018/0251962 A1 9/2018 Levesque

FOREIGN PATENT DOCUMENTS

EP 391826 A1 * 10/1990
EP 856611 A1 * 8/1998
EP 1239086 A1 * 9/2002
FR 2933993 A1 * 1/2010
GB 2170846 A * 8/1986 ..... E02D 29/14
JP 02217526 A * 8/1990 ..... E02D 29/14
WO WO 0011272 A1 * 3/2000 ..... E02D 29/14
WO WO 2010049510 A2 * 5/2010

* cited by examiner

SNAP ON METER PIT EXTENSION

FIELD OF THE INVENTION

The following relates to underground pits for containing items such as meters and valves. More particularly, the following relates to an extension system for pits to allow for a variety of pit lengths to be available with interchangeable extensions. The pits described herein are especially useful in the water/gas utility industry.

BACKGROUND OF THE INVENTION

Meter, valve and other types of pits are typically buried in the ground to contain the meter or valve while allowing access through the top of the pit which is typically covered with a lid. These pits require substantial crush force resistance to avoid damage to the meter/valve and associated plumbing lines. At the same time, different applications of these meter pits may require a variety of lengths, depending on the job requirements, municipal code and others.

Traditional meter pits utilize roto molding and suffer a number of disadvantages, some of which are described in US 2018/0251962 the content of which is incorporated by reference herein. That patent provided for a meter pit which was injection molded and which solved a number of existing problems in meter pits. However, the length of the pit therein is essentially fixed in that a separate part and mold would be required to make a pit which was, for example six inches longer.

Having separate parts for different lengths would result in significant space requirements for storage and significant inventory challenges in that a 30 inch pit could not be used in a 48 inch application.

SUMMARY OF THE INVENTION

Therefore, it is an object of the present invention to provide for interchangeable parts and extensions to meter pits so that a meter pit can be extended by adding an extension piece.

What is further desired is that the extension pieces can stack upon each other to reduce storage space requirements for inventory and shipping.

It is further desired that the extension(s) both alone and combined with the meter pit is/are able to withstand the necessary crush resistance which may be e.g. greater than 10,000 pounds force or more particularly 20,000 pounds force or more.

These and other objects are achieved by providing a pit and an extension, each having flanges extending perpendicular to an axis of the pit and extension. The pit includes holes extending outwardly in the wall of the pit, preferably these holes are located at one end of the pit. Surfaces of the flanges are configured to mate together and clips secure the flanges together to inhibit movement apart of the pit and extension along the axis. In certain embodiments, the extension includes support ribs which may be both interior and exterior and the extension narrows from its flange towards an opposite end thereof.

In one aspect a pit extension system for installation in the ground is provided to house utility items, plumbing devices, valves, meters or the like. The system includes a first piece having at least one flange located at an end, the first piece having a first wall surrounding an inner void, the inner void extending through the first piece in a lengthwise direction, the flange extending outwards transverse to the lengthwise direction to an outer edge of the flange and the flange having a thickness measured in the lengthwise direction. A second piece has first and second ends, the first end comprising a first wall section and a first surface, the first wall section having an inner dimension sized to fit around the edge of the flange and extending from the first surface towards the first end at a first distance greater than the thickness of the flange. The first surface is configured to interact with the flange to limit movement of the first piece relative to the second piece in the lengthwise direction. A plurality of voids are in the first wall section and a plurality of clips are integrally formed to the second piece around an outer wall thereof, the plurality of clips are configured to secure to the at least one flange to thereby secure the first piece to the second piece.

In certain aspects a living hinge is formed in the plurality of clips such that the plurality of clips folds over the living hinge to hold the flange. In other aspects the plurality of clips are located at the plurality of voids such that when each of the plurality of clips are folded over, they insert into a corresponding one of the plurality of voids. In other aspects a catch extends into the plurality of voids such that insertion of each of the plurality of clips into the corresponding one of the plurality of voids is an interference fit and the catch retains the clip in the void. In other aspects a protrusion is located on each of the plurality of clips, the protrusion interacting with the flange to secure the first piece to the second piece and inhibit movement of the first and second pieces apart in the longitudinal direction.

In certain aspects a least one void in each of the plurality of clips extends all the way through the clip. In other aspects at least second and third voids are in each of the plurality of clips, the second and third voids are positioned on either side of the at least one void which extends all the way through the clip. In certain aspects the at least second and third voids extend partially into the clip.

In other aspects the second piece has a wall section and a plurality of ribs extending from the wall section. In other aspects the wall section includes an inwardly tapered portion. In certain aspects the wall section includes ribs extending both outwards and inwards. In other aspects the outwards extending ribs are closer to the second end and terminate at a height measured in the longitudinal direction between the second end and the first surface. In other aspects, the inwards extending ribs are located between the second end and are located below the outwards extending ribs. In certain aspects a portion of the wall section at an inner surface thereof opposite the outwards extending ribs is free of inwards extending ribs.

In other aspects a hole extends though the first wall of the first piece at an end opposite the flange, the hole configured to receive a pipe there through. In other aspects the at least one flange includes at least two flanges located at opposite ends of the first wall of the first piece, the second piece configured to secure to a first one of the at least two flanges. In other aspects a third piece is configured to secure to a second one of the at least two flanges. In certain aspects the third piece includes a wall and two ends, the third piece securable to the first piece at one of the two ends and a second one of the two ends having a hole extending laterally therein in the wall and configured to receive a pipe there through. In other aspects a hole extending though the first wall of the first piece at an end opposite the flange and a protrusion in the third piece extending in the longitudinal direction and configured to insert into the hole in the first wall and sized to fill the hole to inhibit dirt and debris from entering through the hole in the first wall.

In certain aspects a system is provided for adjustable length meter pits including an injection molded pit having a central hole extending there through along an axis of the pit and two holes extending outwards through a wall of the pit, the pit including a flange at an end thereof with a surface perpendicular to the axis of the pit. An injection molded extension has a central hole extending there through along an axis of the extension, the extension including a flange with a surface perpendicular to the axis of the extension. The flange of the pit and the flange of the extension are configured to be aligned such that the surface of the pit and the surface of the extension are in contact. A plurality of clips secure to the extension to the pit via the flanges.

In certain aspects the plurality of clips are integrally molded to the extension. In other aspects the plurality of clips define undercut surfaces which engage with one of the flanges to secure the pit and the extension together. In other aspects, the pit and extension once secured together by the clips are removable from each other by dis-engagement of the clips from the flange of the pit.

Other objects of the invention and its particular features and advantages will become more apparent from consideration of the following drawings, claims and accompanying detailed description.

DETAILED DESCRIPTION OF THE INVENTION

Figure 1A:
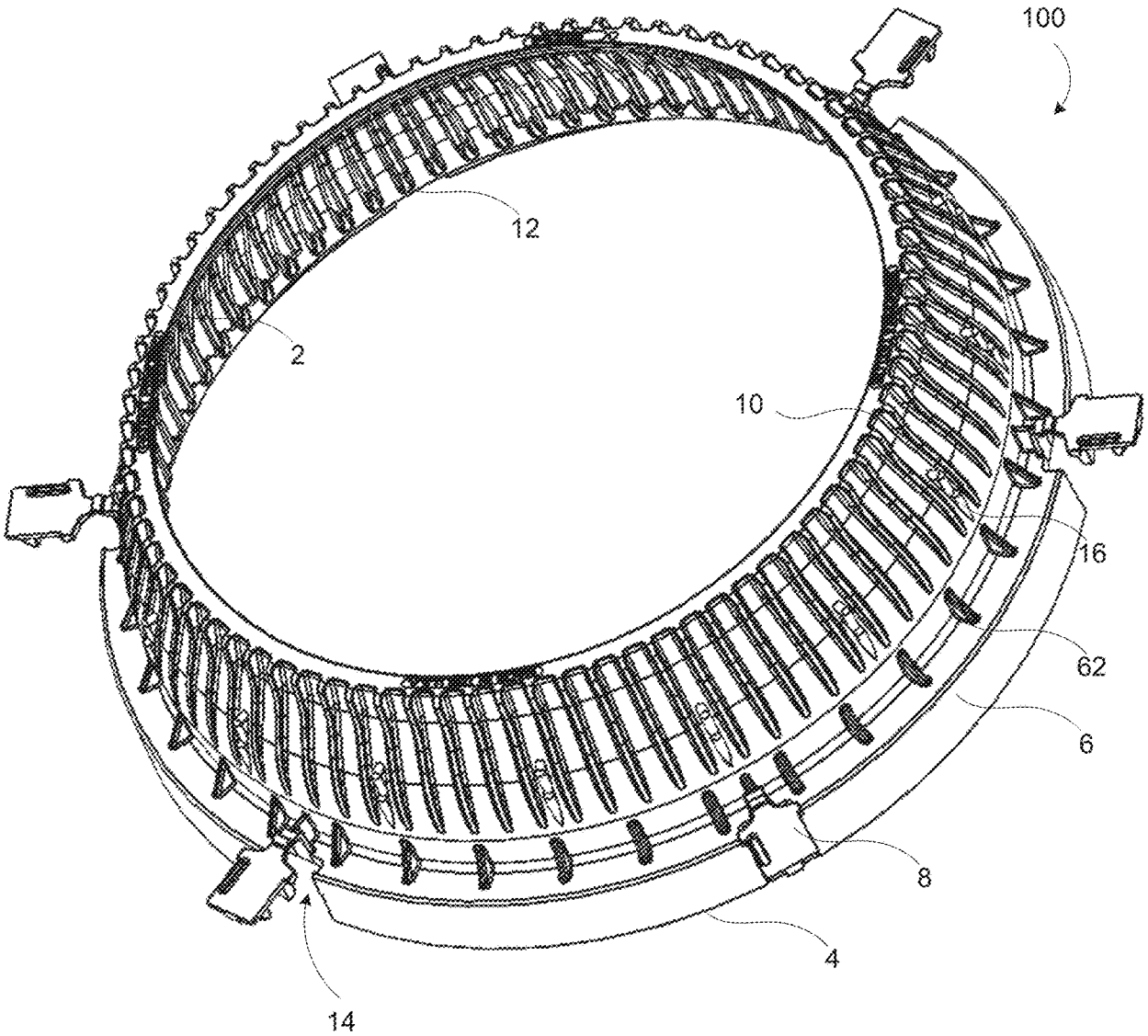
FIG. 1A is a perspective view of a meter pit extension according to the present invention.
Figure 1B:
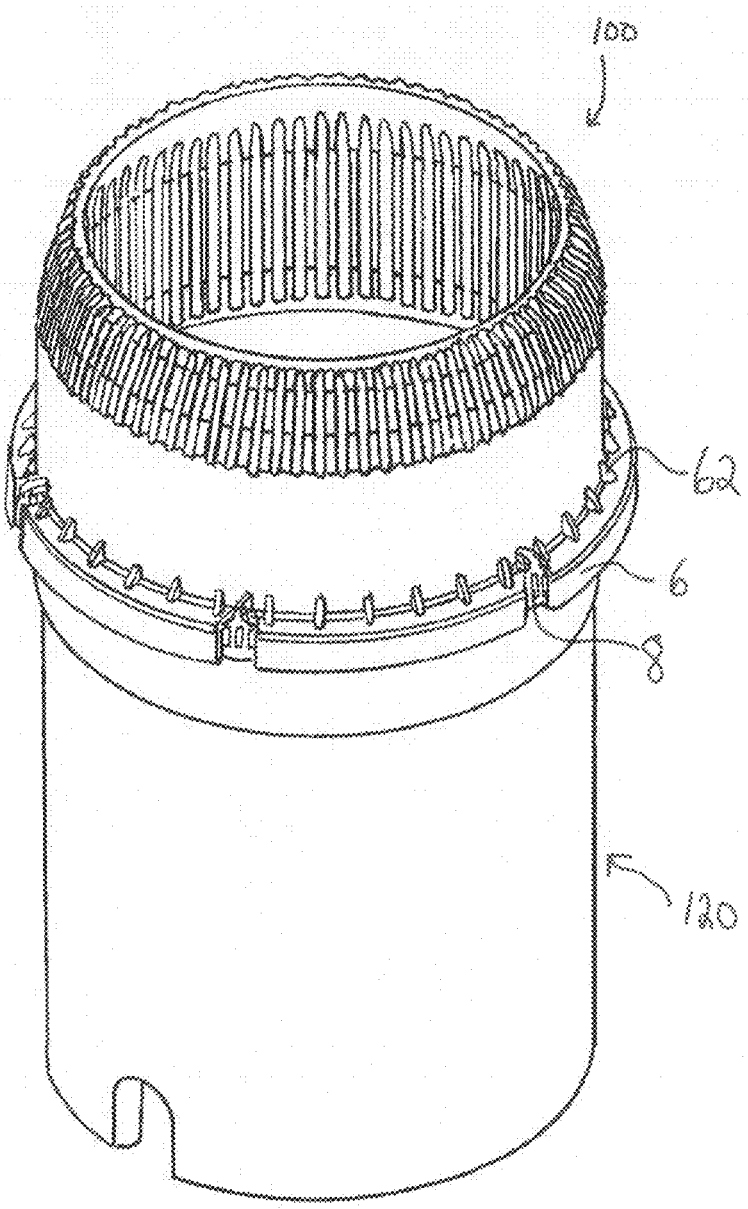
FIG. 1B is a perspective view of the meter pit extension of FIG. 1A secured to a meter pit.
Figure 1C:
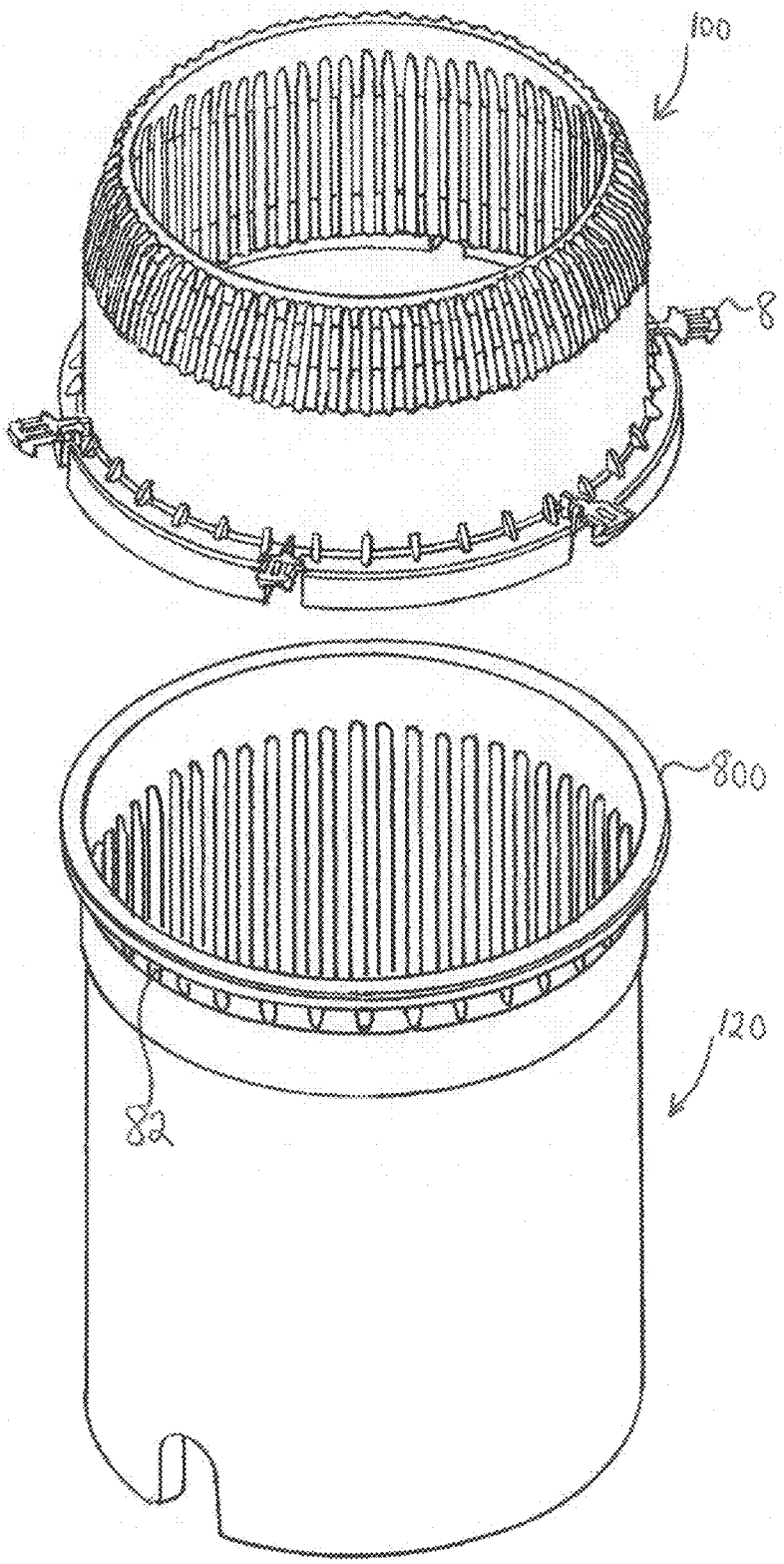
FIG. 1C is an exploded view of FIG. 1B

Referring now to the drawings, wherein like reference numerals designate corresponding structure throughout the views. The following examples are presented to further illustrate and explain the present invention and should not be taken as limiting in any regard.

Referring to FIGS. 1A-E, The pit extension 100 includes upper 2 and lower 4 edges and a wall there between. A section 6 of the wall near the lower 4 edge is designed to receive the pit 120 and particularly its flange 800 within its perimeter to allow for engagement with clips 8. This section 6 is supported in part by section ribs 62 which inhibit bending/displacement of the surface 60 (See FIG. 2) on which flange 800 of the pit 120 rests. The pit extension 100 includes ribs 10/12 as outer 10 and inner 12 ribs. Stacking posts 16 are provided to allow the pit extension 100 to stack on top of another pit extension for easy storage and shipping. In preferred embodiments, the pit 120 extension is injection molded.

Figure 1E:
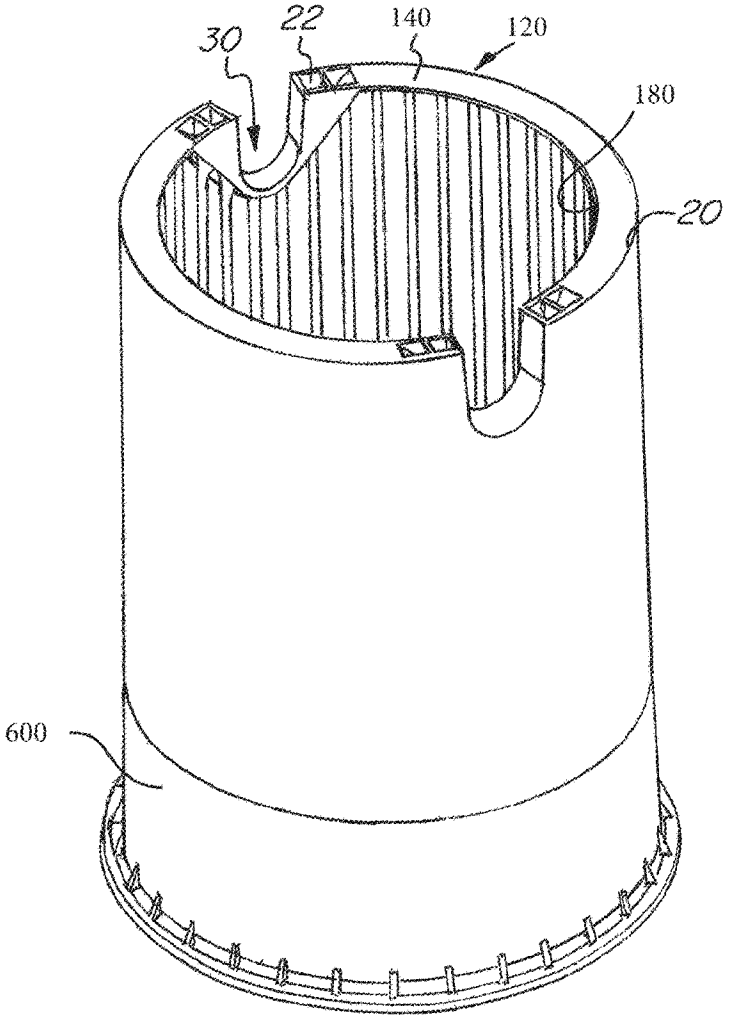
FIG. 1E is a bottom perspective view of FIG. 1D.
Figure 1D:
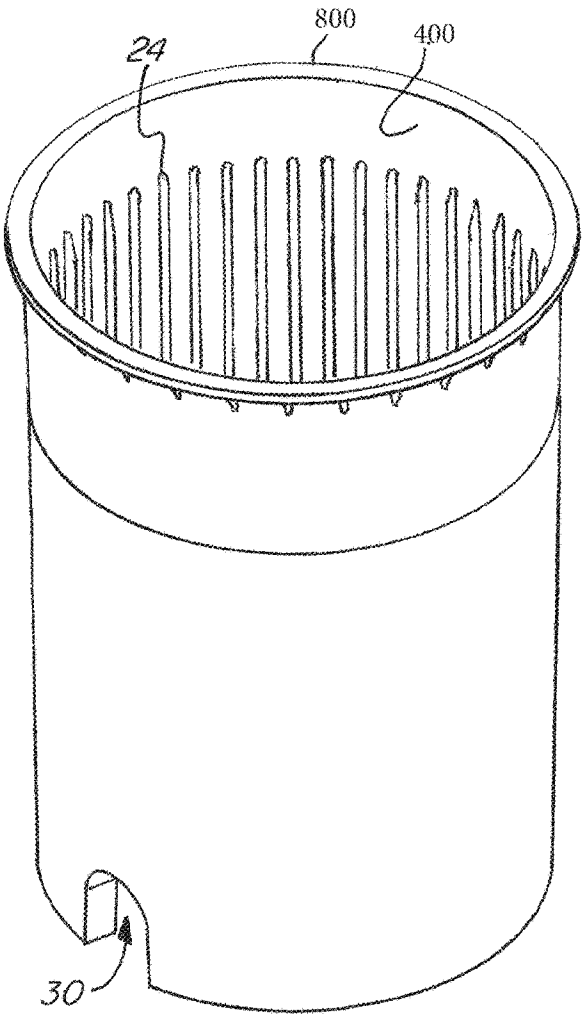
FIG. 1D is a top perspective view of the meter pit of FIG. 1C

Referring to FIG. 1D-E, The pit wall 400 has the extension 800 extending outwards therefrom and flange ribs 82 inhibit bending of the flange 800, particularly when there is a compressive load thereon. The pit includes ribs 24 extending along a length thereof and includes holes 30 to allow pipes to enter the pit so the meter/valve can be contained within the pit. Lower flange 140 extends inwards towards from edge 20 towards edge 180 to provide for a surface which engages the dirt/ground to inhibit settling of the pit. Relief holes 22 reduce the amount of plastic used to create the holes 30 and surrounding structure.

Figure 2:
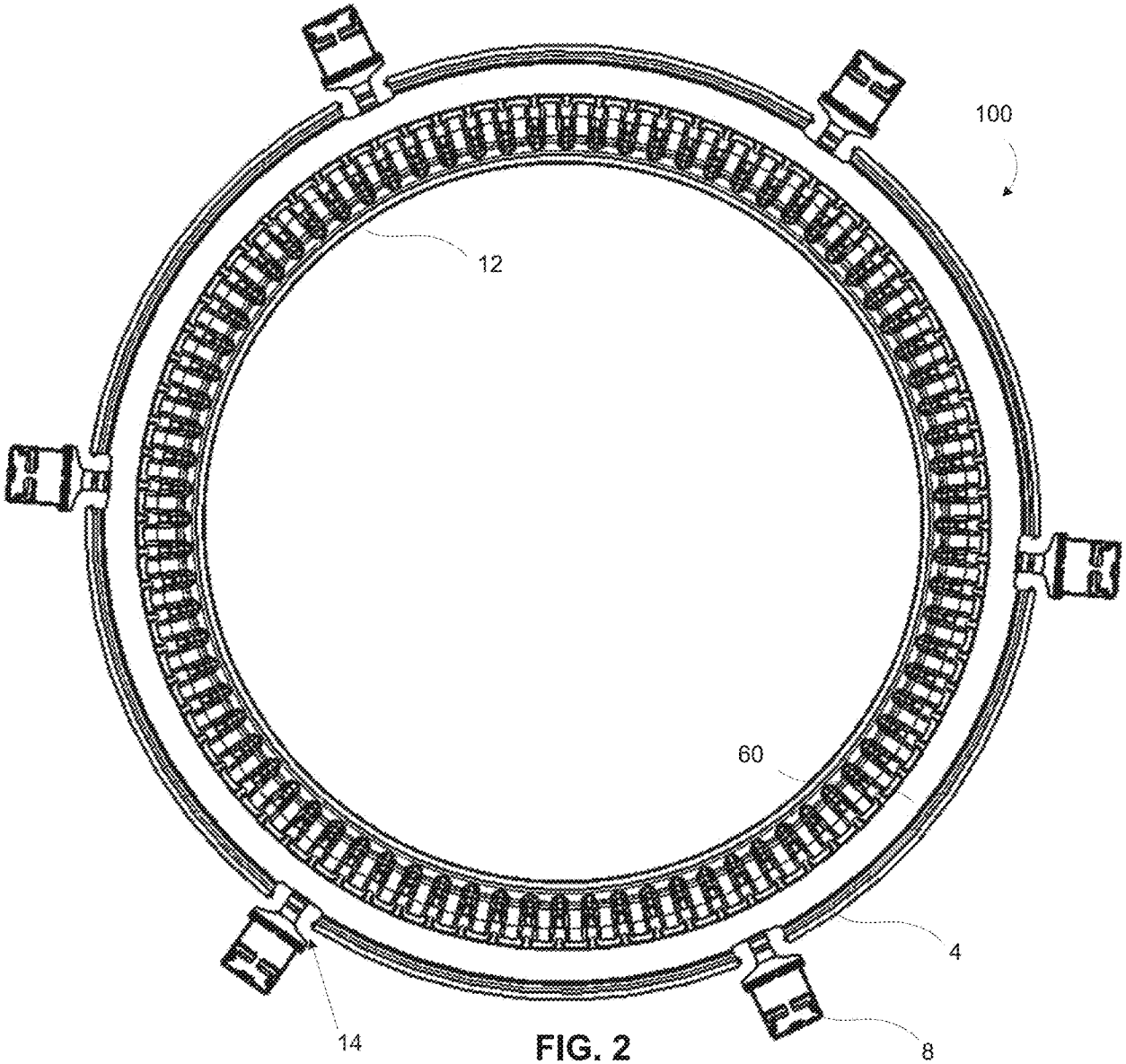
FIG. 2 is a bottom view of FIG. 1A.
Figure 3:
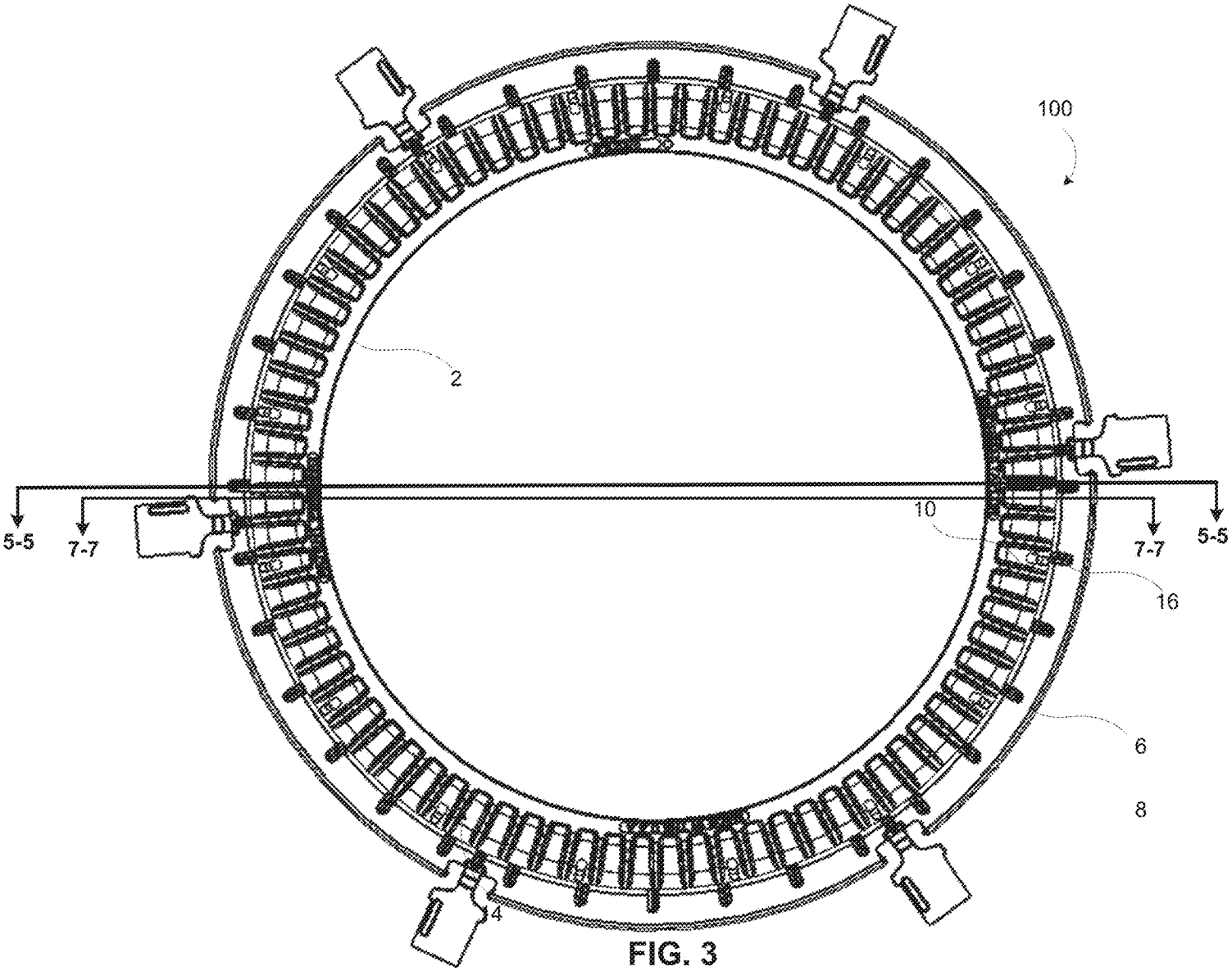
FIG. 3 is a top view of FIG. 1A.
Figure 4:
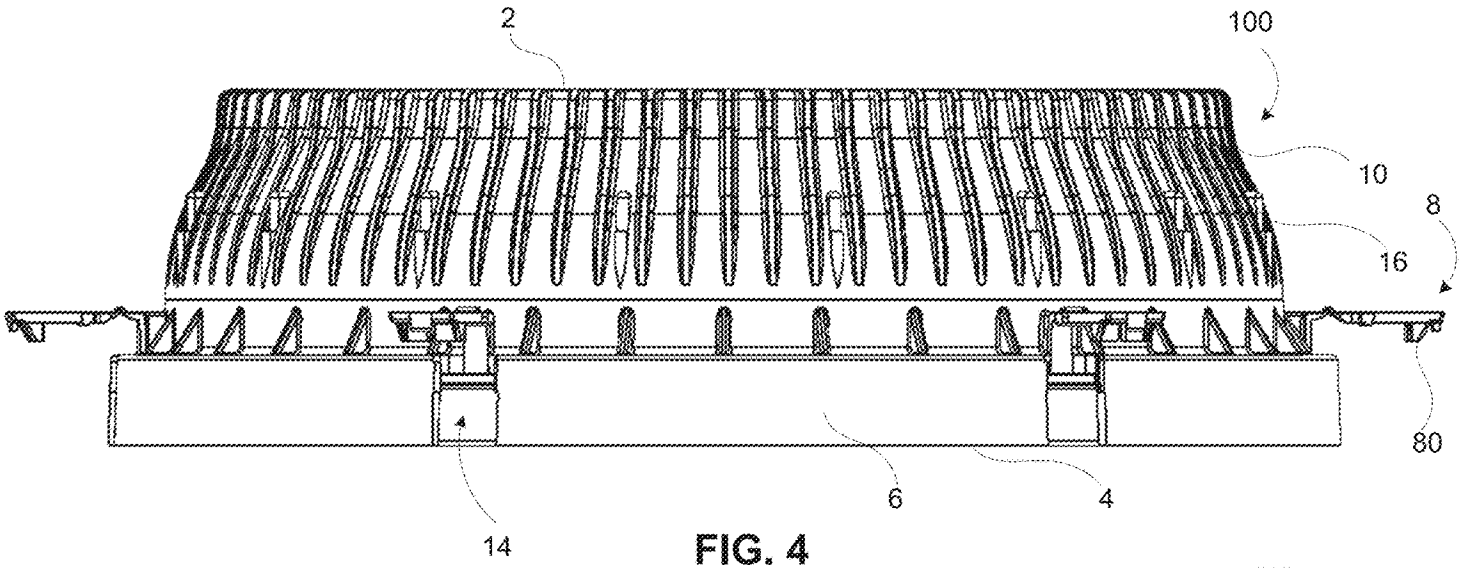
FIG. 4 is a side view of FIG. 1A.

The pit extension 100 is shown from the bottom in FIG. 2 and as can be seen surface 60 is at a distance from edge 4 such that the interior of section 6 is generally a vertical cylindrical wall. The flange 800 of the pit 120 to which the extension 100 secures to will rest against this surface 60, allowing the clips 8 to be folded over and secured in voids 14, thereby holding the flange 120 and inhibiting relative vertical movement apart and thus securely holding the pit extension 100 to the pit 120.

Figure 6:
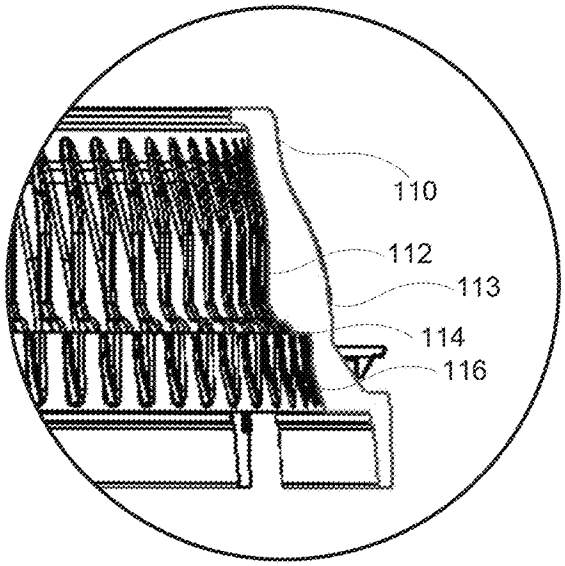
FIG. 6 is a detail view of FIG. 5.
Figure 5:
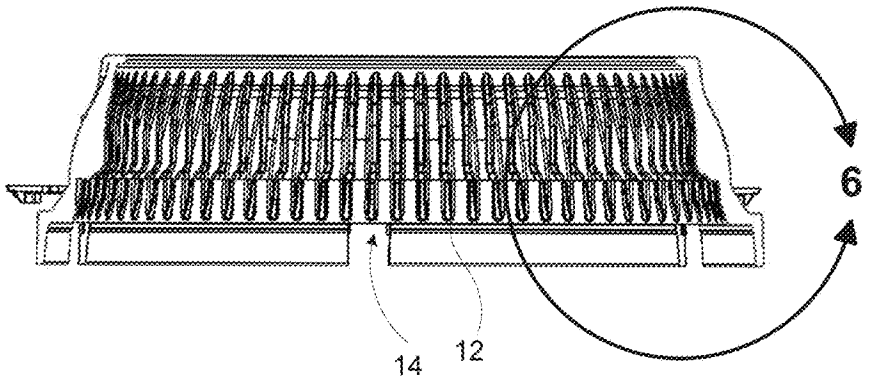
FIG. 5 is a cross section of FIG. 1A along line 5-5.

Further detail of the rib 10/12 is shown in FIG. 6 which is a cross section through the rib 10/12 which includes the inner section 112 of the rib extends downwards and then outwards at ledge 114 and then downwards at rib portion 116. This allows for stacking post 16 to rest against ledge 114 of an extension 100 stacked on top. In this situation, section 112 of the rib would be positioned to slide vertically between two adjacent ribs such that ledge 114 is then contacted. The sizing of section 112 inhibits the section 112 from being stacked directly in line with outer section 10 of the second extension 100. Thus, ensuring that stacking is done with the ribs of the upper extension meshing in between ribs of the lower extension during stacking for purposes of shipping. The inner 12 and outer 10 rib portions which make up the overall rib also provide for adequate structural rigidity of the extension 100, particularly crush resistance. At the same time, the use of ribs and injection molding allows for less plastic material to be used as compared to roto-molded pits. Generally, a roto-molded pit would have a constant wall thickness, resulting in areas which are thicker than necessary to account for a minimum thickness needed to provide for adequate crush resistance in locations of high stress concentrations.

Figure 8:
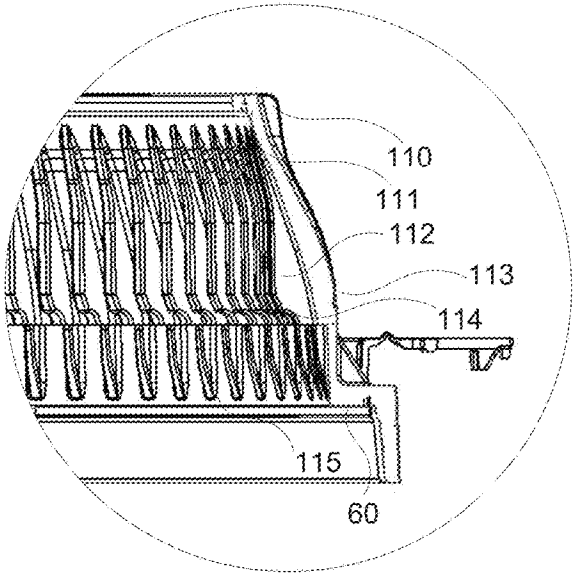
FIG. 8 is a detail view of FIG. 7.

Further detail of the inner 12 and outer 10 rib portions is shown in FIG. 8. Namely, the outer portion begins at the top edge 2 at end 110 and terminates at end 113, between these ends, the rib has a curved outer shape much like an elongated S in that the outer edge of the outer 10 rib portion extends generally downwards, then curving outwards and downwards, then inwards and downwards and then generally downwards until end 113 is reached where the amount which the outer 10 rib portion extends is reduced to zero as the rib becomes flush or even with the outer wall. The thickness of the outer 10 rib portion during this path generally decreases. Inner 12 rib portion starts at end 111 which is spaced below the edge 2 of the pit extension 100. The thickness of this rib (distance it extends inwards) generally increases in the downward direction towards ledge 114 and then decreases towards end 115. As can be seen, the inner 12 rib portion is thickest roughly half way between edge/end 2 and surface 60.

Figure 7:
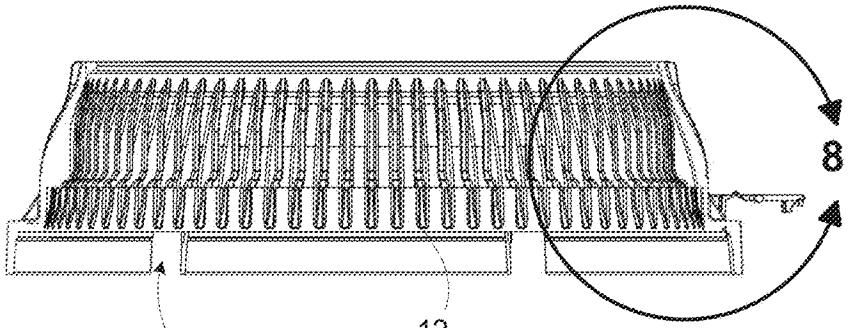
FIG. 7 is another cross section of FIG. 1A along line 7-7.
Figure 9:
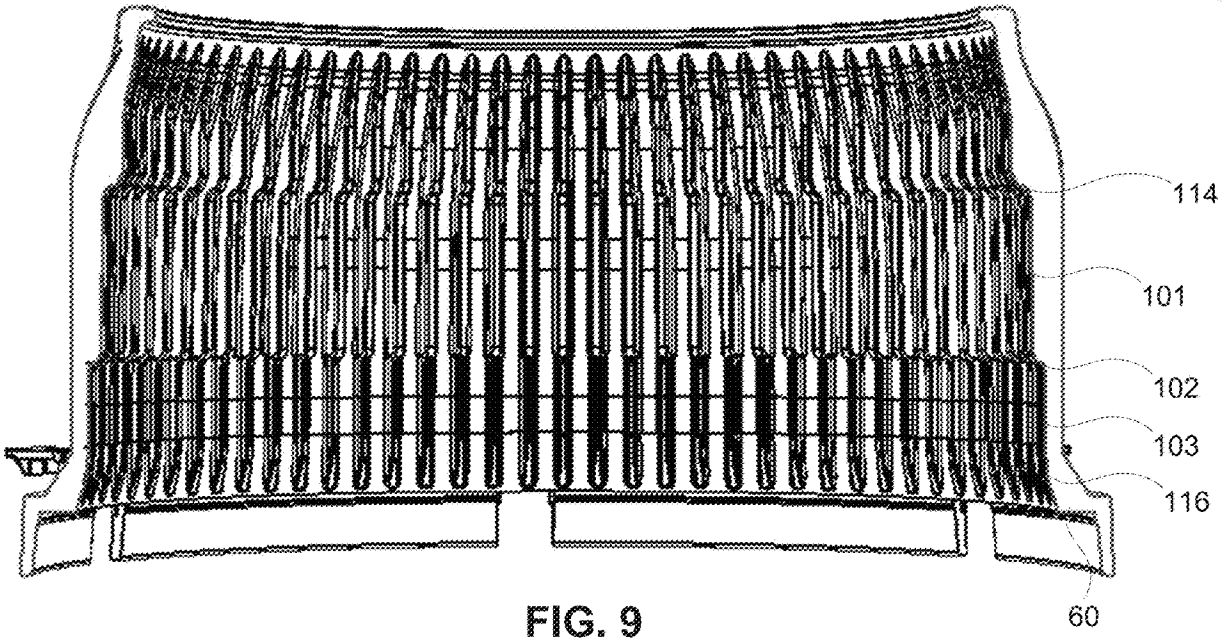
FIG. 9 is a cross section of a longer meter pit extension incorporating features of FIG. 1A.
Figure 10:
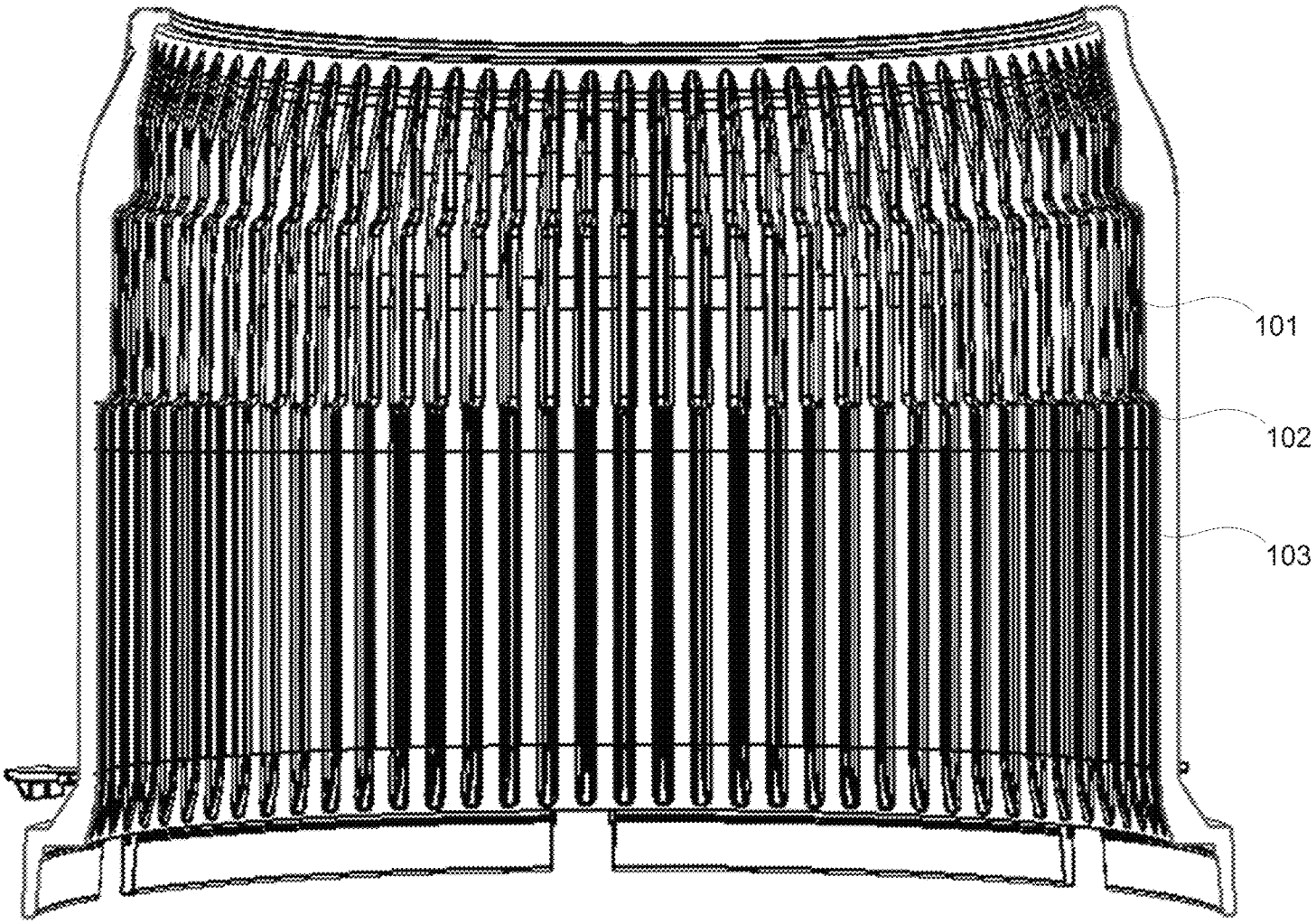
FIG. 10 is another cross section of an even longer meter pit extension incorporating features of FIG. 1A.

FIG. 9 shows a cross section of a longer meter pit extension than that of FIG. 7. As can be seen, sections 101, 102, 103 of the rib and the associated wall are added with the portion above ledge 114 remaining the same as what is shown in FIGS. 1-7. As can be seen, from ledge 114, there is a generally straight 101 inner rib section, another ledge 102 and then another generally straight 103 inner rib section. Next, the rib tapers at section 116 in the same manner as shown in FIG. 6 to the point where surface 60 is provided for engagement with the flange 800 of the pit 120. FIG. 10 is similar to FIG. 9 but that generally straight 103 inner rib section is longer as compared to FIG. 9.

Figure 11:
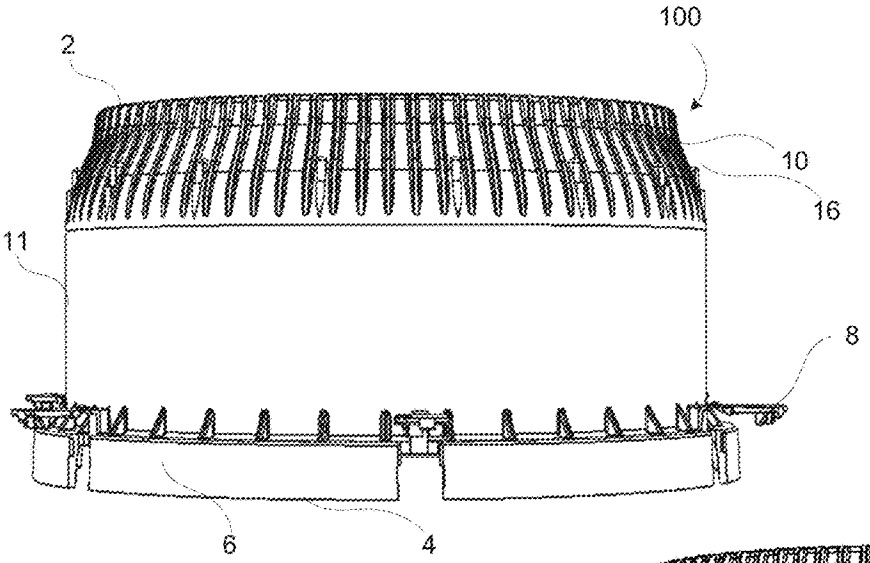
FIG. 11 is a side view of the meter pit of FIG. 9
Figure 12:
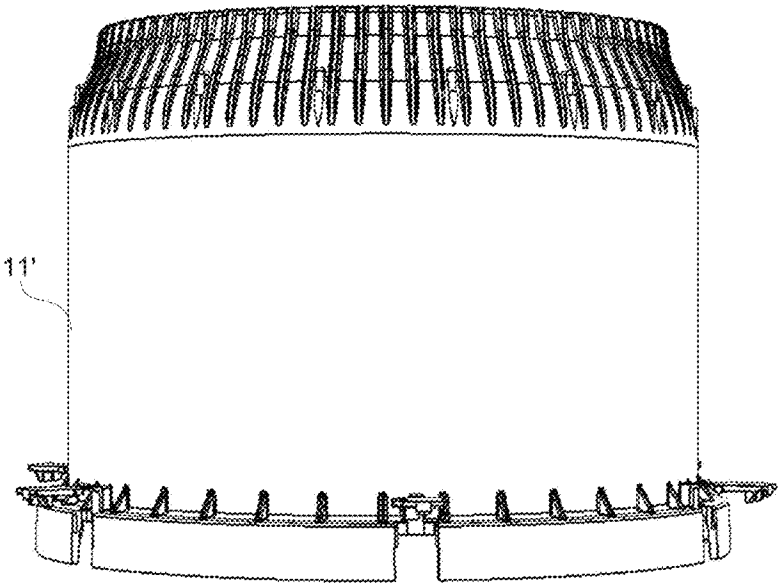
FIG. 12 is a side view of the meter pit of FIG. 10.

FIG. 11 shows the extension of FIG. 9. As can be seen wall 11 is provided as compared to FIGS. 1-8 to provide a longer extension. FIG. 12 shows a longer wall 11' and corresponds the cross section shown at FIG. 10.

Generally, in the three extensions shown, the top portion with the internal/external ribs is the same for the three variants of pit extensions shown. The same holds true for the bottom portion with the clips 8 and the section 6 and surface 60. To provide for longer extensions, the length/use of the longer walls 11/11' and the corresponding ribs/ledges 101/102/103 are selected to provide for varied lengths. The mold used to make the pit extension is also designed to be assembled in stages in that these top and bottom sections which match for all length variants can be assembled together to make a shorter mold, or a series of pieces which provide the inner rib structure 101/102/103 can be added or removed from the mold to thereby vary the length of the mold and thus vary the length of the pit extension.

Figure 13:
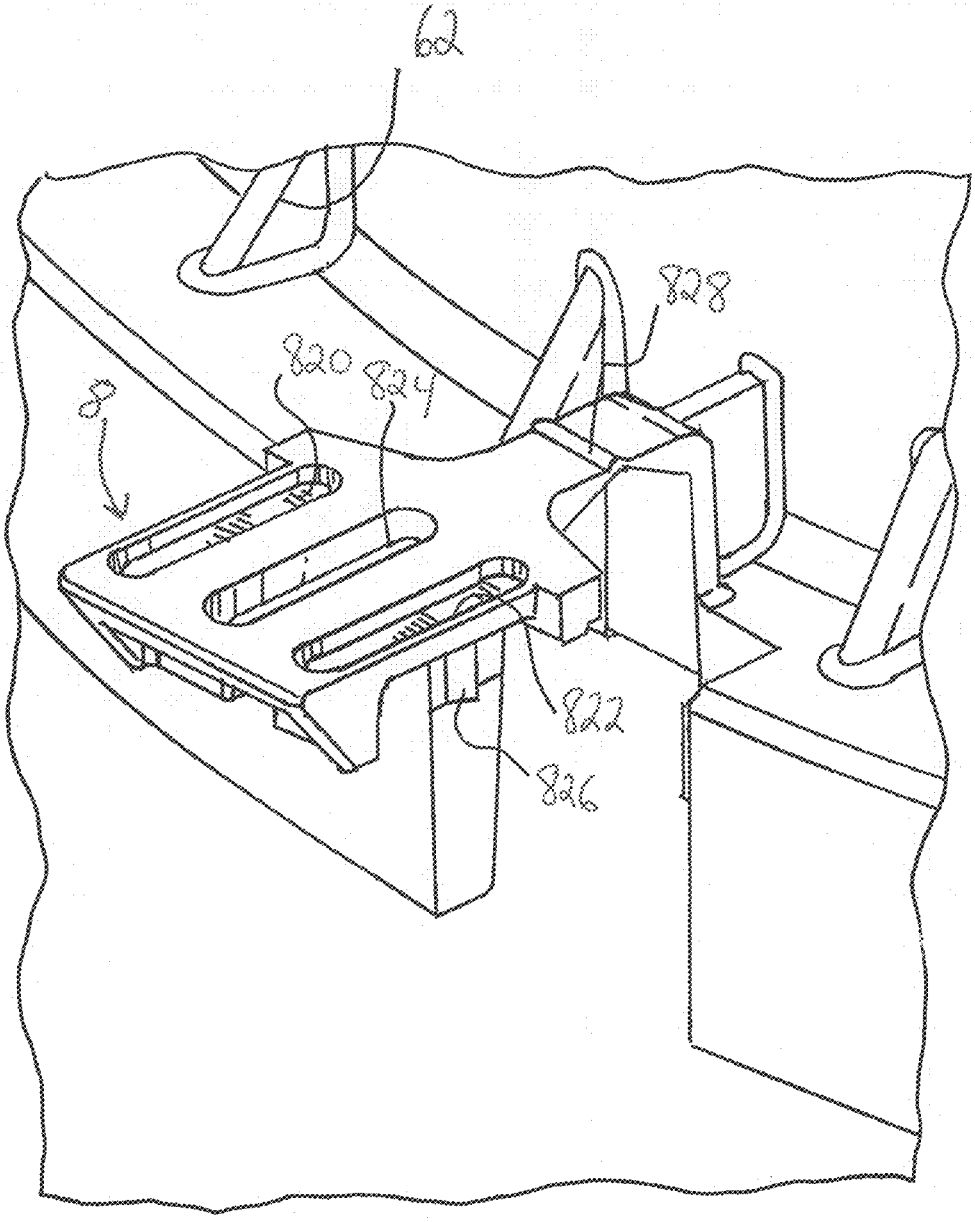
FIG. 13 is a perspective detail view of FIG. 1A.
Figure 14:
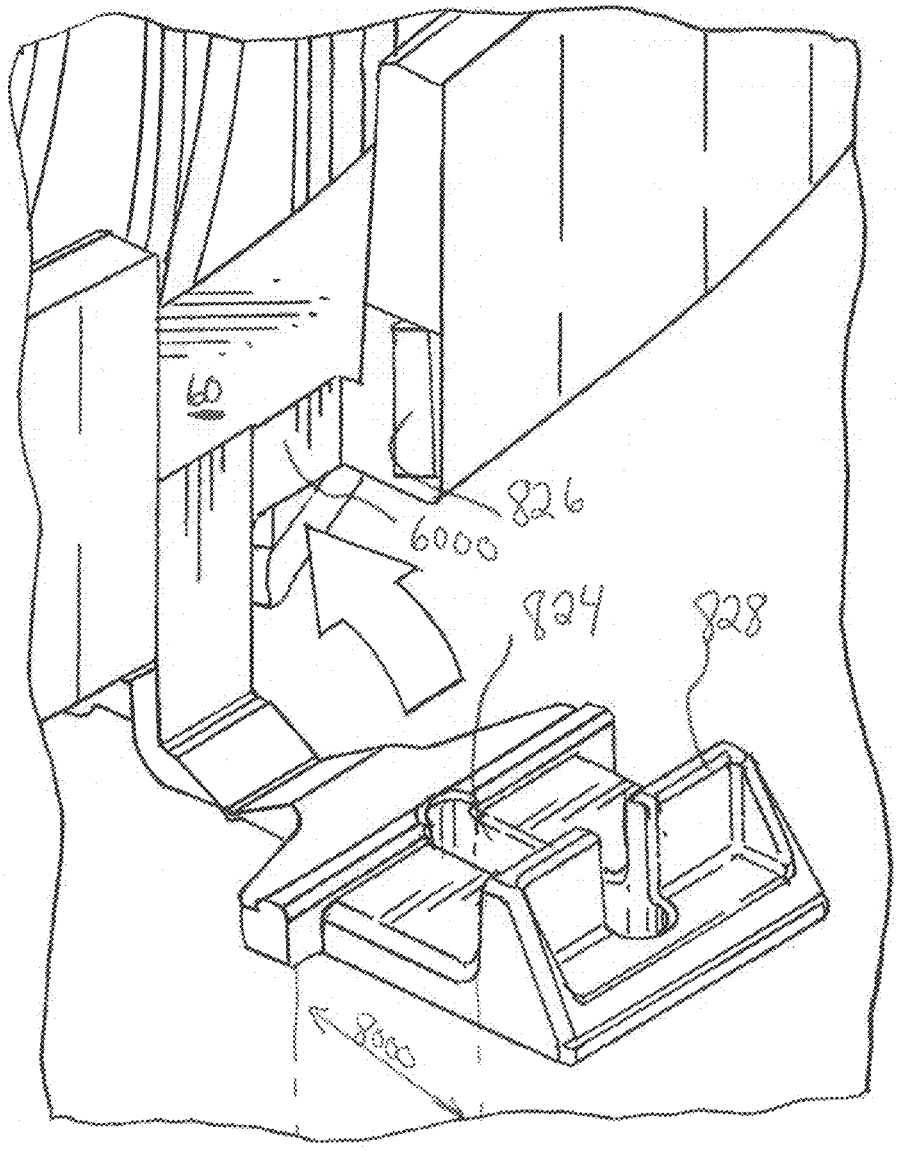
FIG. 14 is a bottom perspective detail view of FIG. 1A.
Figure 15:
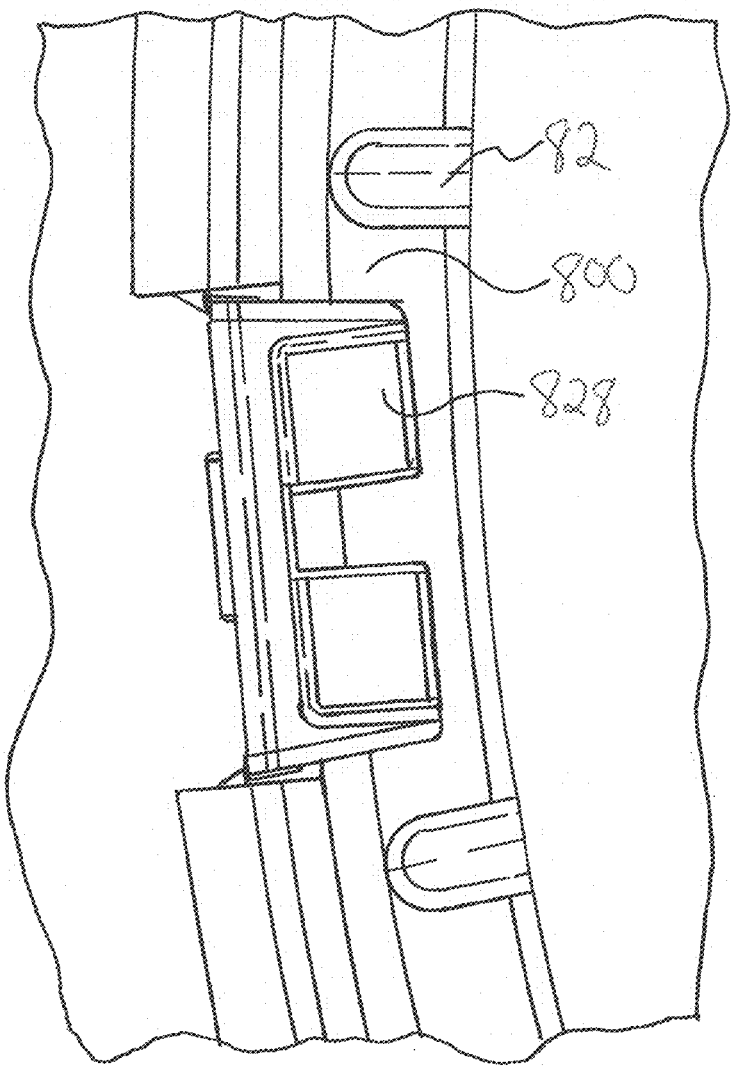
FIG. 15 is a bottom detail view of FIG. 1B.
Figure 16:
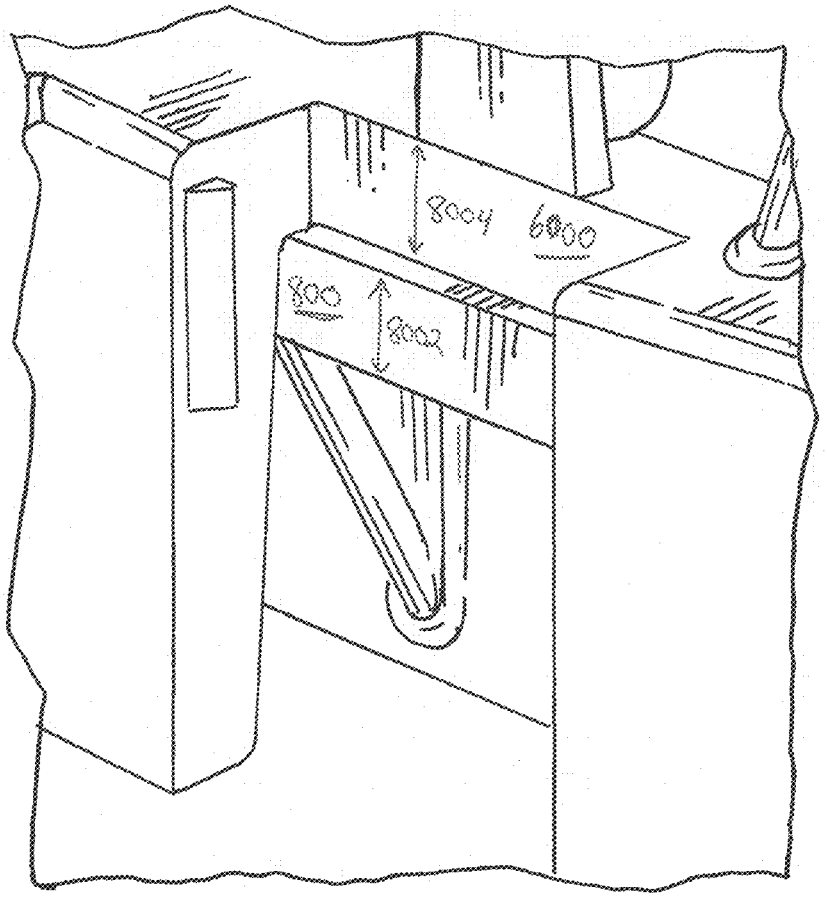
FIG. 16 is a perspective detail view of FIG. 1B with the clip removed.

Referring to FIG. 13, further detail of the clip 8 and surrounding structure is shown. The clip 8 includes living hinge 828 which allows the clip to bend downwards to secure to flange 800 of the pit 120. The clip includes three holes. Holes 820/822 extend part way into the clip whereas hole 824 extends all the way through the clip. In this manner, holes 820/822 can be engaged with a tool and pulled together and hole 824 allows for bending together of the clip to reduce a distance from side to side thereof. This allows the clip 8 to thereby be removed and un-secured/dis-engaged from flange 800 so that the extension 100 can be removed from the pit 120 if necessary. Within opening 140 of the section 6 of the pit extension 120, protrusions 826 are located on either side. The distance from the inner most portions of these protrusions 826 is narrower than a corresponding width of the clip 8. In this manner, the clip will also deform slightly due to hole 824 when the clip is being secured and then once in place, the clip 8 will elastically return back towards its original shape and be held in place by protrusion 826. The underside view of the clip 8 in FIG. 14 shows how hole 824 extends all the way through the clip 8 to provide for the ability to deform for purposes of securing and detaching the clip 8. Further protrusion 828 extends from the clip and secure to the flange 800. The distance 8000 is equal to or slightly larger than the sum of the thickness 8004 of flange 6000 and the thickness 8002 of flange 800 (See FIG. 16). As seen in FIG. 15, the protrusion 828 and clip 8 is designed to fit between two flange ribs 82.

Figure 17:
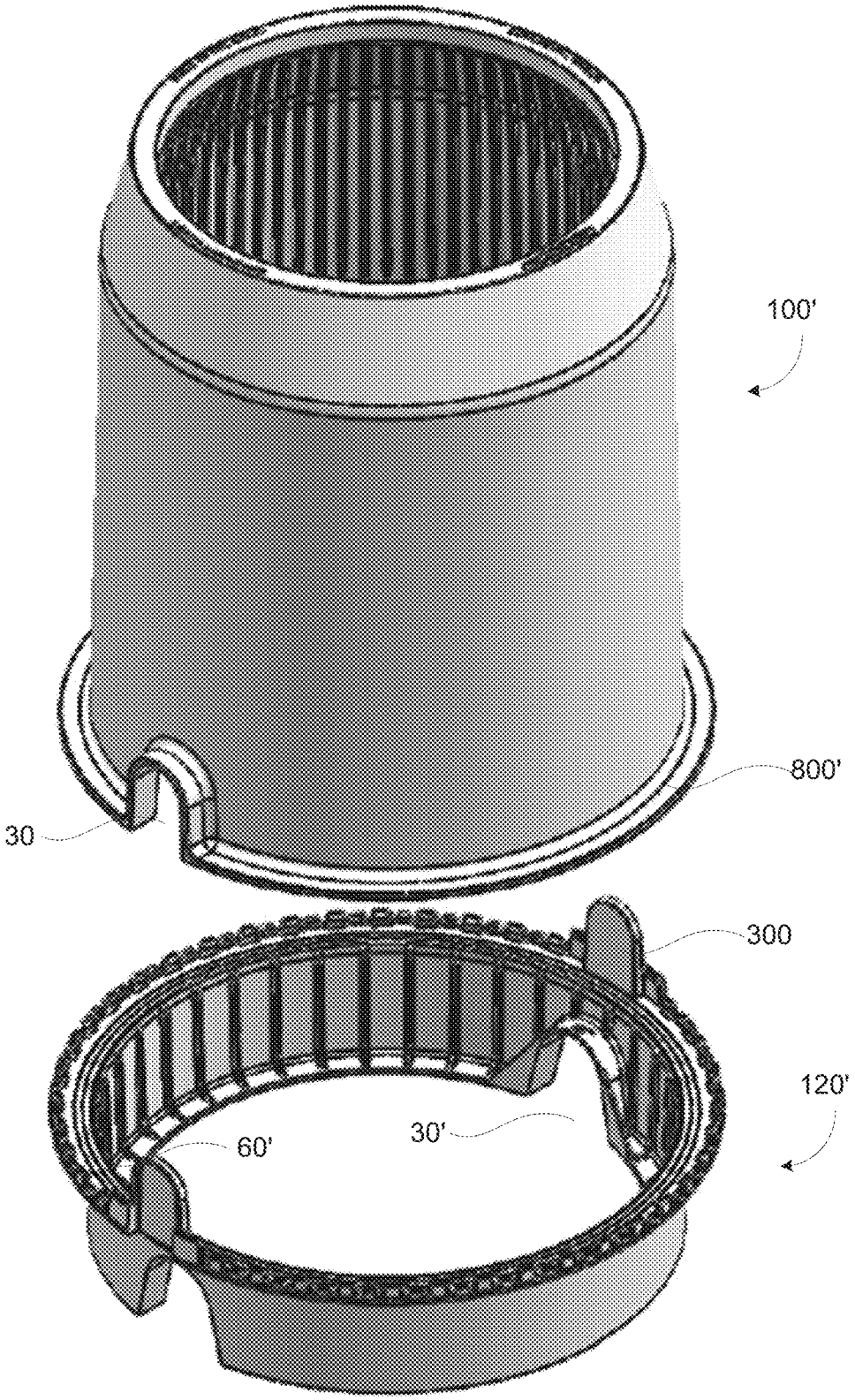
FIG. 17 is a perspective exploded view of a meter pit with an extension.
Figure 18:
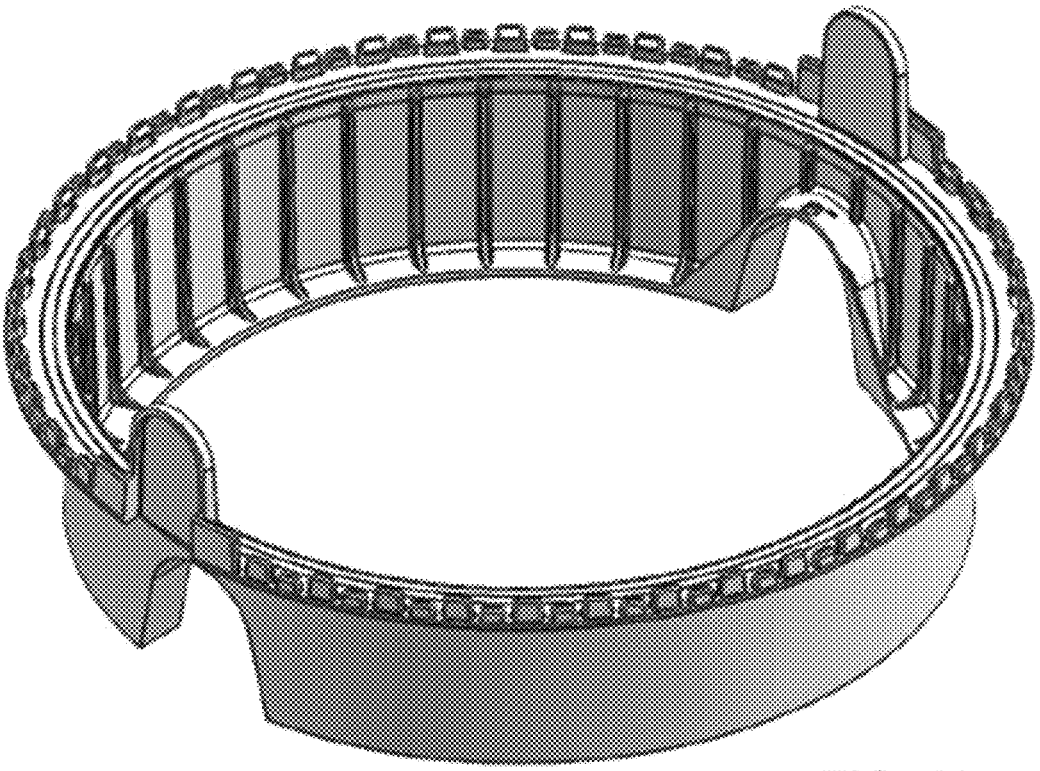
FIGS. 18 and 19 are respectively top and bottom perspective views of the extension in FIG. 17.
Figure 19:
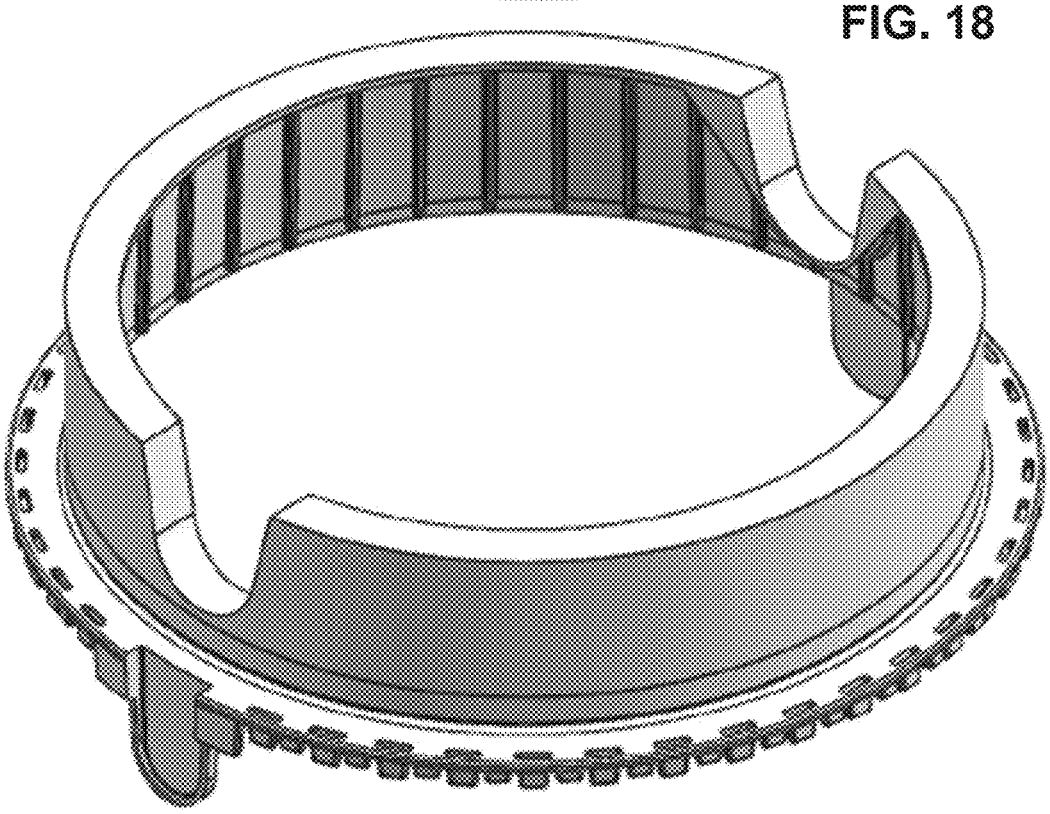
Figure 20:
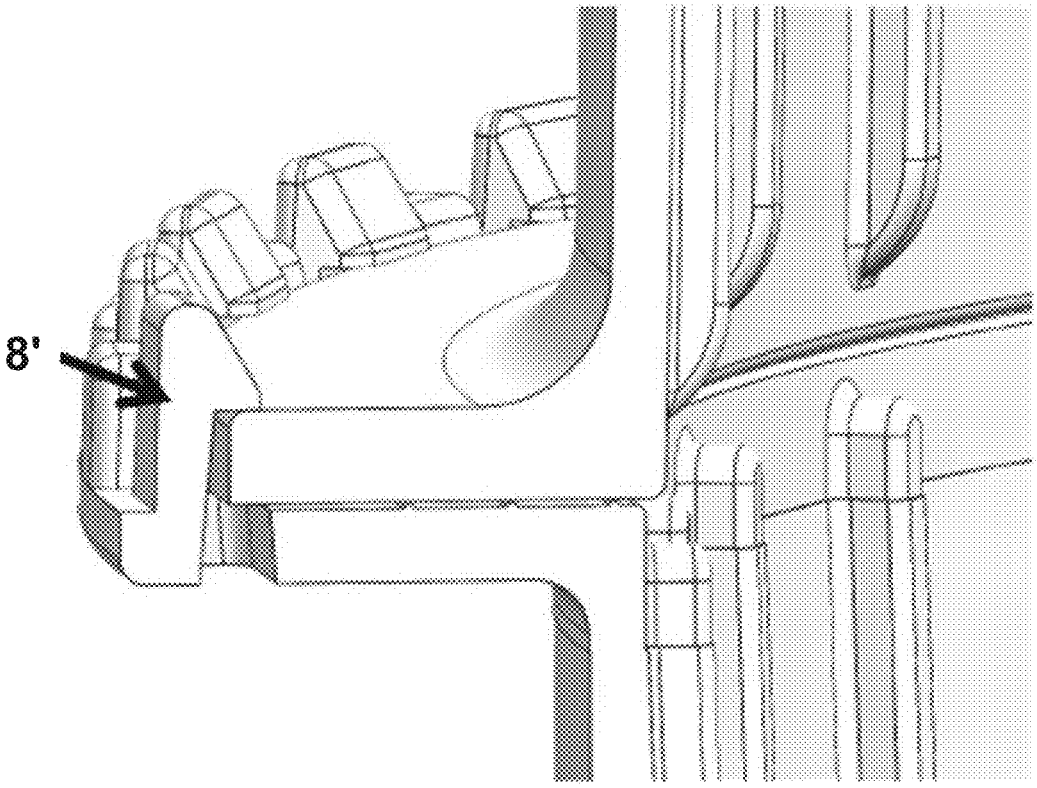
FIGS. 20 and 21 are different two cross section views of FIG. 18.
Figure 21:
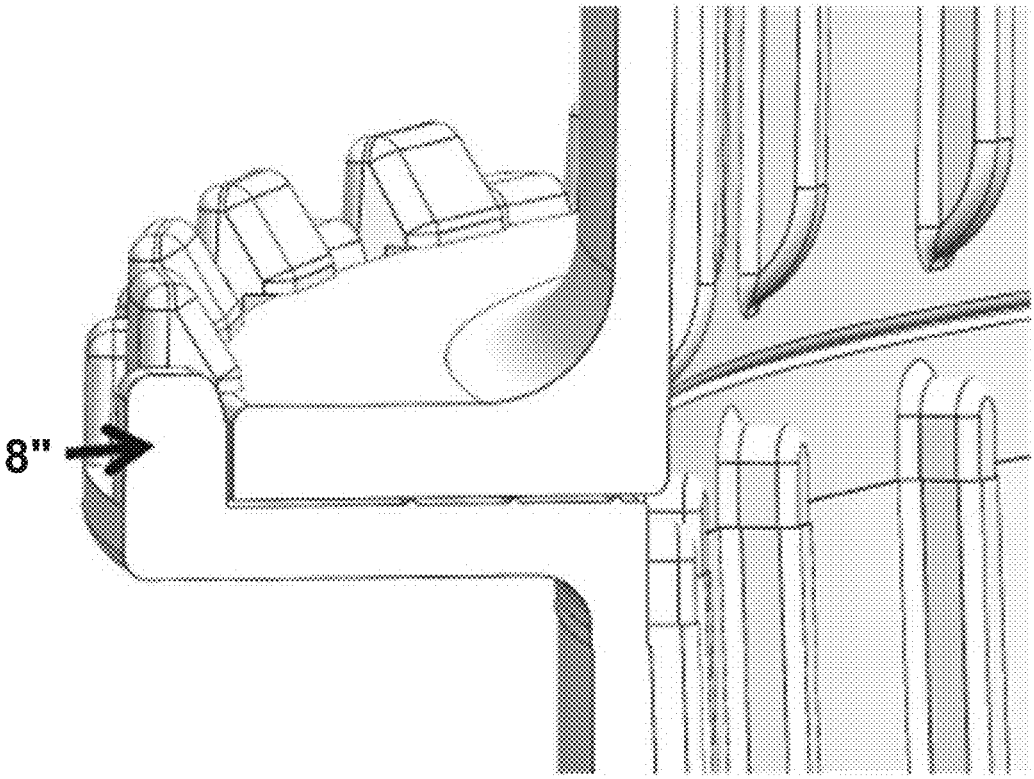

FIG. 17 shows an extension 120' which secures to a bottom of a pit 100'. FIG. 18-19 show additional detail of that extension 120'. Surface 60' abuts flange 800' and extension 300 fits in hole 30 to inhibit dirt from entering the pit where the original hole 30 for the pit (with no extension) would receive pipes there through. Holes 30' are provided in the extension 120' to allow for the pipes to enter the extension for receiving the meter pit. FIGS. 20 and 21 show cross sections of the clip structure which secures extension 120' to pit 100'. Namely, clip 8' extends from the flange on which surface 60' is located. This clip secures to flange 800' and posts 8" between the clips help hold the flanges of the extension 120' and the pit 100' in alignment. It is also understood that the clip structure of FIG. 1 could be employed instead of the one shown in FIG. 20. It is also understood that the pit 100' or 100 could be provided with flanges on either end to allow for extensions to be secured on either side.

Through use of the rib designs provided herein, the pits and extensions both alone and as assembled can withstand adequate crush forces for purposes of their applications. Particularly, at least 10,000 pounds force, at least 15,000 pounds force or even more preferable at least 20,000 pounds force can be withstood by the pieces individually and when assembled to each other. In particular aspects, the extensions allow for the pits to be extended at least 4 inches, more particularly at least 5.5 inches, at least 6 inches at least 8 inches, at least 11.5 inches, at least 12 inches, at least 15 inches, at least 17.5 inches, at least 18 inches or more. These pits also provide for the upper section with the inward/outward ribs and the lower section with the clips to be identical across a number of different length pits with intermediate section(s) added as necessary to extend the pit length by adding corresponding mold pieces to thereby create a longer/shorter pit.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A pit extension system for installation in the ground to house utility items, plumbing devices, valves, or meters comprising:

a first piece having at least one flange located at an end, the first piece having a first wall surrounding an inner void, the inner void extending through the first piece in a lengthwise direction, the flange extending outwards transverse to the lengthwise direction to an outer edge of the flange and the flange having a thickness measured in the lengthwise direction;

a second piece having first and second ends and an inner void extending through the second piece between the first and second ends, the first end comprising a first wall section and a first surface, the first wall section having an inner dimension sized to fit around the edge of the flange and extending from the first surface towards the first end at a first distance greater than the thickness of the flange;

the first surface configured to interact with the flange to limit movement of the first piece relative to the second piece in the lengthwise direction;

a plurality of voids which extend through the first wall section;

a plurality of clips integrally formed to the second piece around an outer wall thereof, the plurality of clips configured to secure to the at least one flange to thereby secure the first piece to the second piece;

a living hinge formed in the plurality of clips such that the plurality of clips folds over the living hinge to hold the flange and the plurality of clips are located at the plurality of voids such that when each of the plurality of clips are folded over, they insert into a corresponding one of the plurality of voids in the first wall section.

2. The system of claim 1 further comprising:

a catch extending into the plurality of voids such that insertion of each of the plurality of clips into the corresponding one of the plurality of voids is an interference fit and the catch retains the clip in the void.

3. The system of claim 2 further comprising a protrusion located on each of the plurality of clips, the protrusion interacting with the flange to secure the first piece to the second piece and inhibit movement of the first and second pieces apart in the longitudinal direction.

4. The system of claim 1 wherein the second piece has a wall section and a plurality of ribs extending from the wall section.

5. The system of claim 4 wherein the wall section includes ribs extending both outwards and inwards.

6. The system of claim 5 wherein the outwards extending ribs are closer to the second end and terminate at a height measured in the longitudinal direction between the second end and the first surface.

7. The system of claim 6 wherein the inwards extending ribs are located between the second end and are located below the outwards extending ribs.

8. The system of claim 7 wherein a portion of the wall section at an inner surface thereof opposite the outwards extending ribs is free of inwards extending ribs.

9. The system of claim 1 wherein the first wall section includes an inwardly tapered portion.

10. The system of claim 1 further comprising a hole extending though the first wall of the first piece at an end opposite the flange, the hole configured to receive a pipe therethrough.

11. The system of claim 1 wherein the at least one flange includes at least two flanges located at opposite ends of the first wall of the first piece, the second piece configured to secure to a first one of the at least two flanges.

12. The system of claim 11 further comprising a third piece configured to secure to a second one of the at least two flanges.

13. The system of claim 12 wherein the third piece includes a wall and two ends, the third piece securable to the first piece at one of the two ends and a second one of the two ends having a hole extending laterally therein in the wall and configured to receive a pipe there through.

14. The system of claim 13 further comprising a hole extending though the first wall of the first piece at an end opposite the flange and a protrusion in the third piece extending in the longitudinal direction and configured to insert into the hole in the first wall and sized to fill the hole to inhibit dirt and debris from entering through the hole in the first wall.

15. A pit extension system for installation in the ground to house utility items, plumbing devices, valves, or meters comprising:

a first piece having at least one flange located at an end, the first piece having a first wall surrounding an inner void, the inner void extending through the first piece in a lengthwise direction, the flange extending outwards transverse to the lengthwise direction an outer edge of the flange and the flange having a thickness measured in the lengthwise direction;

a second piece having first and second ends and an inner void extending through the second piece between the first and second ends, the first end comprising a first wall section and a first surfaced, the first wall section having an inner dimension sized to fit around the edge of the flange and extending from the first surface towards the first end at a first distance greater than the thickness of the flange, the first surface configured to interact with the flange to limit movement of the first piece relative to the second piece in the lengthwise direction;

a plurality of voids which extend through the first wall section;

a plurality of clips integrally formed to the second piece around an outer wall thereof, the plurality of clips configured to secure to the at least one flange to thereby secure the first piece to the second piece;

a living hinge formed in the plurality of clips such that the plurality of clips folds over the living hinge to hold the flange; and at least one void in each of the plurality of clips which extends all the way through the clip and allows edges of the clip to flex inwardly, the flexing inwardly reducing a size of the at least one void when the clip is folded over to insert into a corresponding one of the plurality of voids.

16. The system of claim 15 further comprising at least second and third voids in each of the plurality of clips, the second and third voids positioned on either side of the at least one void which extends all the way through the clip.

17. The system of claim 16 wherein the at least second and third voids extend partially into the clip.

* * * * *